United States Patent [19]

Tsuruoka

[11] Patent Number: 4,881,017

[45] Date of Patent: Nov. 14, 1989

[54] DISPLAY DEVICE WITH STRETCHED ELECTRODE ASSEMBLIES HAVING DIFFERENT RESONANT FREQUENCIES

[75] Inventor: Yoshihisa Tsuruoka, Mobara, Japan

[73] Assignee: Futaba Denshi Kogyo Kabushiki Kaisha, Mobara, Japan

[21] Appl. No.: 164,900

[22] Filed: Mar. 7, 1988

[30] Foreign Application Priority Data

Mar. 20, 1987 [JP] Japan ..... 62-64325

[51] Int. Cl.[4] ..... H01J 17/49; H01J 63/02; H01J 19/42

[52] U.S. Cl. ..... 313/495; 313/422; 313/269; 313/584

[58] Field of Search ..... 313/495, 422, 585, 269, 313/583, 584

[56] References Cited

U.S. PATENT DOCUMENTS 3,666,981 1/1972 Lay ..... 313/584

4,449,149 5/1984 Inohara et al. ..... 313/422 X 4,542,322 9/1985 Irie et al. ..... 313/422 X

FOREIGN PATENT DOCUMENTS 2103956 8/1971 Fed. Rep. of Germany ..... 313/269

*Primary Examiner*—Palmer C. DeMeo

*Attorney, Agent, or Firm*—Oblon, Spivak, McClelland, Maier & Neustadt

[57] ABSTRACT

A display device capable of preventing vibration of control electrodes stretched in an envelope. The control electrodes are divided into two assemblies or a main control electrode assembly and an auxiliary control electrode assembly arranged in contact with or in proximity to the main control electrode assembly so that vibrations of both control electrode assemblies may damp each other due to a difference between natural frequency therebetween, thereby restraining vibration of the control electrodes.

8 Claims, 2 Drawing Sheets

DISPLAY DEVICE WITH STRETCHED ELECTRODE ASSEMBLIES HAVING DIFFERENT RESONANT FREQUENCIES

BACKGROUND OF THE INVENTION

1. Field of the Invention

This invention relates to a display device such as a vacuum fluorescent display device which includes at least two sets of electrode groups which are arranged in directions intersecting each other to form a matrix in an envelope and driven to effect any desired graphic display, and more particularly to a display device which is adapted to prevent vibration of the electrode groups.

2. Description of the Prior Art

Recently, a flat panel display device such as a vacuum fluorescent display device, a liquid crystal display device, an EL panel, a PDP or the like has been developed and put to practical use for effecting any desired display of a letter, a figure, an image or the like as in a cathode ray tube. Such a display device is generally called a graphic display device and includes a matrix electrode structure which is so constructed that two kinds of electrode groups (X electrode group and Y electrode group) are arranged so as to be spaced from each other and extend in directions intersecting each other and picture cells which are provided at intersections between both electrode groups. The graphic display device is driven in such a manner that one of the electrode groups is scanned and a display signal is applied to the other electrode group in synchronism with the scanning, thereby selectively driving any desired picture cells for luminous display.

FIG. 6 schematically illustrates a basic structures of a vacuum fluorescent display device used in the conventional graphic display device described above. The fluorescent display device generally indicated by reference numeral 1 in FIG. 6 includes an anode substrate 2 made of a light-permeable insulating material such as glass or the like and a plurality of strip-like anodes 3 arranged in parallel to one another on an inner surface of the anode substrate 2. A phosphor is deposited on each of the anodes 3 which emits light due to impingement of electrons. Also, the fluorescent display device 1 includes an electron source which may be made of a plurality of cathodes 6 stretched on a cover plate 4 by means of supports 5 opposite to the anode substrate 2 and discharges electrons due to heating. Between the anodes 3 and the cathodes 6, there is provided a control electrode group 8 which may be made of a plurality or wire electrodes. The control electrode group 8 is arranged in a direction across the anodes 3 spaced at a predetermined distance from the anodes 3 by spacers 7 which is made of an insulating material. The wire electrodes for the control electrode group 8 each may be formed of a material such as 426 alloy which has a thermal expansion coefficient approximating to that of a material such as glass for the anode substrate 2 and side plates 9 so that the electrodes may be in a shape of a fine line by etching or fine punching. Thus, the anodes 3 and control electrode group 8 constitute X and Y electrode groups, and the phosphors located at virtual intersections of both electrode group which are viewed from an observation direction may form picture cells each constituting a display unit. In the fluorescent display device, thus constructed, when a scan signal is supplied to one of the electrode groups and a display signal is supplied to the other electrode group in synchronism with the scanning, any desired picture cells are selectively driven to effect any desired graphic display. These electrodes are housed in an envelope which is formed of the anode substrate 2, side plates 9 and cover plate 4, and is then evacuated to a high vacuum.

There is known a graphic display device other than that shown in FIG. 6 which includes an anode formed by depositedly applying a phosphor layer all over an inner surface of an anode substrate and X and Y control electrode groups stretchedly arranged above the anode so as to be vertically spaced from each other and extend in directions intersecting each other. In the graphic display device, when one of the X and Y control electrode groups is driven for scanning and a display signal is supplied to the other control electrode group while positive voltage is applied to the anode, the phosphor layer located at intersections of both X and Y control electrode groups are selectively driven to effect desired luminous display.

A graphic display device which includes, in addition to control electrodes for selecting picture cells, a linear electrode group which is arranged between anodes and cathodes to deflect electron beams is also known in the art.

In each of the conventional graphical display devices described above, when drive voltage is applied to one of the electrode groups stretched in the envelope to cause potential to be generated between the one electrode group and the other electrode group arranged opposite thereto at a predetermined interval, electrostatic attractive force is created between both electrode groups to which drive voltage is selectively applied for scanning. The electrostatic attractive force is periodically generated, which causes the electrode groups to vibrate. Furthermore, the electrode groups cause resonance depending on relationships between a cycle of scanning of the electrode groups (a drive frequency thereof) and a natural frequency of the electrode groups. As a result, the vibration is amount to a large magnitude.

Also, the electrode groups stretched in the envelope readily vibrate due to external force applied thereto. This is remarkable in a large-sized display device wherein long linear electrodes are stretched between supports spaced at a large distance from each other.

Brightness or luminance of each picture cell in each of the conventional display devices is significantly affected by a distance between the cathodes and the control electrodes. Accordingly, when the control electrodes vibrate due to the electrostatic attractive force and/or external force, the distance between the control electrodes is changed, which causes luminous display of the device to flicker and deteriorate quality of the display. In addition, vibration of the electrodes causes short circuit by contacting the electrodes with other electrodes and the display device or a driving circuit thereof is damaged.

In order to solve the above problems due to vibration of the electrode groups, there is proposed a fluorescent display device which is disclosed in Japanese Patent Laying-Open Publication No. 188837/1986. The fluorescent display device disclosed in the publication is so constructed that vibration control wire is incorporated in a plurality of linear grids stretched in parallel to one another in an envelope in a manner to extend in the direction across the grids to prevent vibration of the grids. However, the fluorescent display device disclosed fails to practice, because the manufacturing is highly troublesome and costly.

Another fluorescent display device developed for the purpose of eliminating the above problems is disclosed in Japanese Patent Application Laying-Open Publication No. 250943/1985. The fluorescent display device is so constructed that insulating spacers are provided between strip-like anodes arranged in a stripe-like manner and linear grids are put directly on the insulating spacers, thereby preventing vibration of the linear grids. However, such a construction of the fluorescent display device fails to fully prevent vibration of the linear grids, and sound or noise due to contact between the linear grids and the spacers is generated. Also, electrons is charged on the spacers, thus, a height of the spacers must be limited and the linear grids are liable to contact with phosphor layers of the anodes. Furthermore, the fluorescent display device has another disadvantage that the linear grids are readily damaged, because they are stretched under a high tension in order to prevent ther vibration.

SUMMARY OF THE INVENTION

The present invention has been made in view of the foregoing disadvantages of the prior art.

Accordingly, it is an object of the present invention to provide a display device which is capable of effectively preventing vibration of electrode groups stretched in an envelope so as to eliminate flickering of display and short-circuit.

It is another object of the present invention to provide a display device which is capable of ensuring its safe operation for a long period of time.

It is a further object of the present invention to provide a display device which is capable of providing luminous display with a high quality.

It is still another object of the present invention to provide a display device which is capable of accomplishing the foregoing objects with a simple structure.

In accordance with the present invention, a display device is provided. The display device includes at least two sets of electrode groups arranged in directions intersecting each other in an envelope. The electrode groups are selectively driven by selectively driving a plurality of display sections defined at intersections between the electrode groups and adjacent thereto to effect luminous display. At least one of the two sets of the electrode groups stretched in the envelope is constituted by a combination of a main electrode assembly and an auxiliary electrode assembly arranged in contact with or in proximity to the main electrode assembly. The main electrode assembly and auxiliary electrode assembly of the fluorescent display device of the present invention have different natural frequency so that vibrations of both electrode assemblies may damp or attenuate each other and vibration of the whole electrode may be substantially restrained.

BRIEF DESCRIPTION OF THE DRAWINGS

These and other objects and may of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENTS

Figure 1:
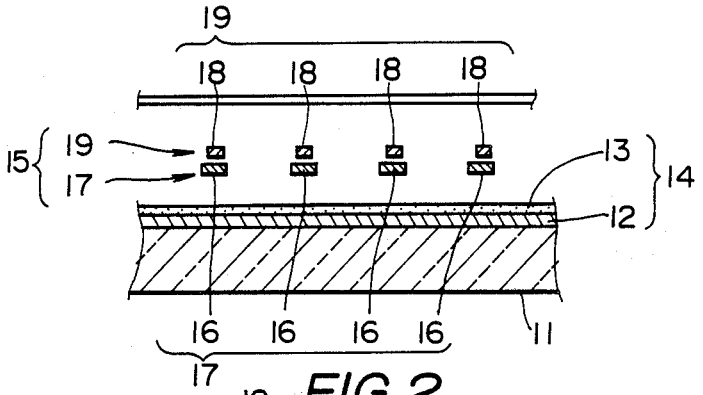
FIG. 1 is a fragmentary sectional view showing an essential part of an embodiment of a display device according to the present invention.

Now, a display device according to the present invention will be described in detail with reference to FIGS. 1 to 5.

Embodiments shown in the drawings each are directed to a display device to which a principle of fluorescent display device is applied and which is improved in electrode groups stretched in an envelope.

FIG. 1 shows an embodiment of a fluorescent display device according to the present invention, wherein a matrix is constituted by anodes and control electrodes. The display device of the illustrated embodiment includes an anode substrate 11 constituting a part of an envelope. On an inner surface of the anode substrate 11 are arranged a plurality of strip-like or linear anode conductors 12 in parallel to one another at predetermined intervals. The anode conductors 12 each have a phosphor layer 13 deposited thereon to form a plurality of strip-like or linear anodes 14 constituting one electrode groups.

The display device also includes control electrode 15 constituting the other electrode group stretched in a direction perpendicular to and above the anodes 14. The control electrode 15 includes a main control electrode assembly 17 comprising a plurality of main control electrodes 16 formed into a rectangular shape in cross section and arranged in parallel to one another above the anodes 14. Also, the control electrode 15 includes an auxiliary control electrode assembly 19 comprising a plurality of auxiliary control electrodes 18 arranged above the respective main control electrodes through a gap of a microdistance. In the illustrated embodiment, the gap may be maintained between the main control electrodes 16 and the auxiliary control electrodes 18 by means of spacer means (not shown) provided at a periphery of the envelope so as to be interposed between both control electrodes 16 and 18. The main control electrode 16 and auxiliary control electrode 18 are vertically opposite within the envelope and contacted at a sealing region 20 of the envelope so as to hermetically pass therethrough as shown in FIG. 2, and then led out to an exterior of the envelope.

Control electrodes for both main and auxiliary control electrode assemblies 17 and 19 each may be made by subjecting a metal sheet to etching or fine pressing or punching. In the illustrated embodiment, both control electrodes 16 and 18 are formed to have dimensions (width and thickness) different from each other in order to cause natural frequencies of both control electrodes 16 and 18 to be different from each other. However, as a matter of fact, it is impossible to make both control electrodes 16 and 18 exactly in the same dimensions and configuration as is apparent to those skilled in the art. The natural frequency of both control electrodes 16 and 18 becomes naturally different from each other when they are manufactured separately. Thus, it will be understood that the dimensioning of both control electrodes 16 and 18 is just for convenience of design of the electrodes and is not essential to the present invention.

Also, even when both control electrodes 16 and 18 are formed natural frequency of both electrodes becomes different if the electrodes are stretched under different tensions, and the vibration of the whole control electrode 15 is effectively prevented.

Figure 2:
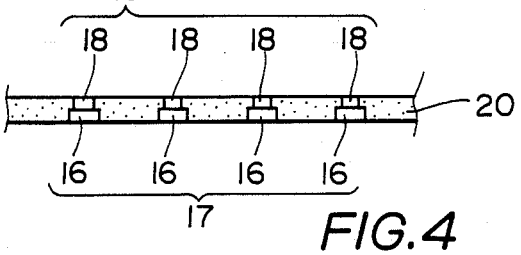
FIG. 2 is a fragmentary schematic view of the display device of FIG. 1 showing a manner of leading out control electrodes to an exterior of an envelope.
Figure 3:
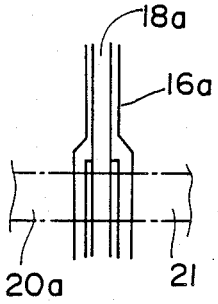
FIGS. 3 and 4 each are a fragmentary schematic view of the display device of FIG. 1 showing another manner of leading out control electrodes to an exterior of an envelope.
Figure 4:
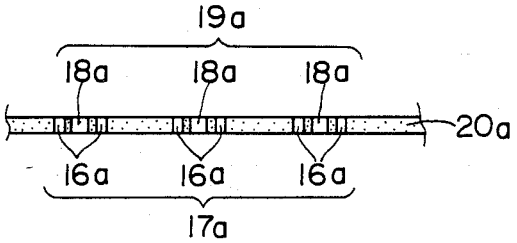

FIGS. 3 and 4 show a modification of the embodiment shown in FIGS. 1 and 2, wherein an end of each of main control electrodes **16*a* is bifurcated or divided into two, and a corresponding auxiliary control electrode 18*a* is inlayed in a gap therebetween. The main and auxiliary control electrodes 16*a* and 18*a* pass through a sealing region 20*a* of the envelope 21, and then the electrodes are led out to an exterior of the envelope 21. According to the construction shown in FIGS. 3 and 4, the sealing region 20*a* of the envelope 21 can be decreased in thickness equivalent to the thickness of the control electrodes 16*a* and 18*a***.

According to the present invention, the control electrode 15 is constituted by the main control electrode assembly 17 and auxiliary control electrode assembly 19 different in natural frequency from each other. Accordingly, even when electrostatic attractive force and/or external force are applied to the control electrode 15 during driving, and both control electrode assemblies 17 and 19 are vibrated, the vibrations of both assemblies damp or attenuate each other. As a result, the vibration of the whole control electrode means 15 is effectively restrained, to thereby prevent flickering of luminous display and short-circuit and improve its reliability.

Inasmuch as the display device of the present invention prevents short-circuit an interval between the control electrode 15 and the anodes 14 can be reduced. Accordingly, electrons passing through the control electrode means 15 are directly impinged on the anodes 14 without being diffused and deflected. This eliminates bleeding, indistinctness and flickering of luminous display and high quality of the luminous display is attained. In order to increase transmittance of electrons and efficiently control electrons, it is preferable to form the control electrodes 16 and 18 to have a smaller width and heavy thickness in the direction of passing electrons. The control electrodes 17 and 19 formed by etching cannot be decreased its width beyond 60% of the total thickness of a material for the electrodes. The control electrode vertically arranging two kinds of the control electrodes 16 and 18 permits a width of the control electrode 15 to be substantially decreased to one half, which results in significantly improving luminance of the display device. According to the present invention, vibration of the control electrode 15 can be effectively prevented. Accordingly, it is not necessary to apply high tension to the control electrode so that it may be stretched, and also to check default of the control electrode 15 severely as heretofore, thereby improving yields of the control electrode and decrease manufacturing costs of the display device.

Figure 5:
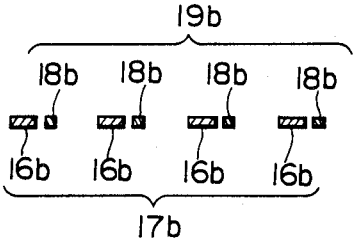
FIG. 5 is a fragmentary sectional view showing control electrodes in another embodiment of a display device according to the present invention.
Figure 6:
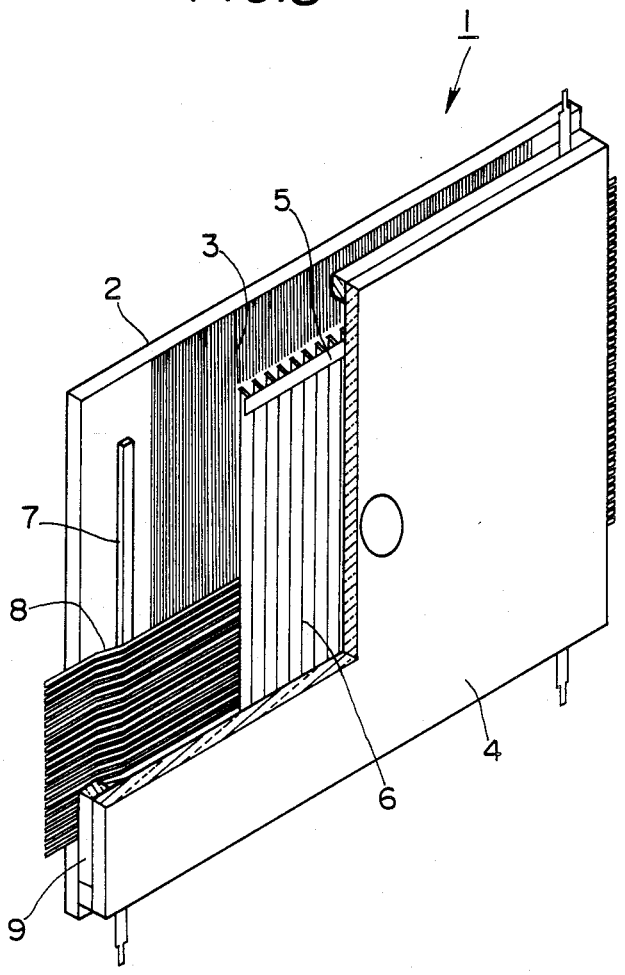
FIG. 6 is a partially cutaway perspective view showing a conventional fluorescent display device for graphical display.

In the embodiments shown in FIGS. 1 and 2, the main control electrode assembly 17 and auxiliary control electrode assembly 19 are arranged in a manner to be vertically adjacent to each other at a small interval. The interval may be determined depending on a configuration and dimensions of the electrodes and the like. Alternatively, both control electrode assemblies may be contacted with each other without such an interval. In the embodiment shown in FIGS. 1 and 2, the main control electrode assembly 17 and auxiliary control electrode assembly 19 are arranged so as to be vertically opposite to each other in view of the fact that electrostatic attractive force causing vibration of the electrodes generally acts in a vertical direction in FIG. 1. However, when it acts in a horizontal direction or in a lateral direction in FIG. 1, they may be arranged in such a manner as in another embodiment of the present invention shown in FIG. 5. The embodiment shown in FIG. 5 is so constructed that each of main control electrodes **16*b* of a main control electrode assembly 17*b* and an auxiliary control electrode 18*b* of an auxiliary control electrode assembly 19*b* corresponding thereto are arranged on the same plane. The remaining structure of the embodiment shown in FIG. 5 may be constructed in substantially the same manner as in the embodiment of FIG. 1**.

In each of the embodiments, the matrix is constituted by the control electrodes and anodes. However, the present invention is not limited to the display device described above, but a matrix may be constituted by an anode having a luminous section on the entire surface of the anode and X and Y control electrodes arranged above the anode. Furthermore, the present invention is applicable to a display device wherein anodes and control electrodes each comprise a linear electrode.

In each of the display devices, the X and Y control electrodes and anode(s) can be formed in the anti-vibration structure.

The present invention has been described with respect to a vacuum fluorescent display device. However, it is applicable various kinds of display devices other than the fluorescent display device, such as, for example, a high voltage driven type display device which is generally called a flat type cathode ray tube wherein various kinds of control electrodes are superposed on one another at predetermined intervals.

As can be seen from the foregoing, in the display device of the present invention, at least one of the electrode groups stretched in the envelope is constituted by the main electrode assembly and auxiliary electrode assembly. Such a construction effectively prevents vibration of the electrode groups stretched in the envelope. Accordingly, the present invention can eliminate flickering of display, short-circuit, bleeding and indistinctness of display. Also, it is possible to apply a high drive voltage to the display device, and to illuminate the display device with a high luminance. According to the present invention the electrodes are not required to stretch under a high tension, which results in a decrease in damage of the electrodes, an increase in yields and a decrease in costs.

While preferred embodiments of the invention have been described with a certain degree of particularly with reference to the drawings, obvious modifications and variations are possible in the light of the above teachings. It is therefore to be understood that within the scope of the appended claims, the invention may be practiced otherwise than as specifically described.

What is claimed as new and desired to be secured by Letters Patent of the United States is:

1. A display device comprising:

an envelope;

at least two sets of electrode groups arranged in directions intersecting each other within said envelope, one of said electrode groups being stretched in a space within said envelope;

said electrode group stretched in said space including a main electrode assembly wherein said main electrode is bifurcated and such that one of each of the auxiliary electrodes in the assembly is arranged so as to be in the gap of each of said main electrodes in the assembly; and a plurality of display sections defined at intersections between said two sets of electrode groups, said display sections being selectively driven for luminous display by driving said two sets of electrode groups.

2. A display device comprising:

a vacuum envelope;

at least two sets of electrode groups selected from the group consisting of an anode, cathode and a control electrode, said two sets of electrode groups being arranged in directions intersecting each other within said envelope and one of said electrode groups being stretched in a space within said envelope;

said electrode group stretched in said space including a main electrode assembly and an auxiliary electrode assembly maintained at the same electrical potential wherein said auxiliary electrode assembly is placed adjacent to said main electrode assembly such that a one to one correspondence exists between the two assemblies and such that the resonant frequency of each of said assemblies is different; and a plurality of display sections defined at intersections between said two sets of electrode groups, said display sections being selectively driven for luminous display by driving said two sets of electrode groups.

3. The display device as defined in claim 2, wherein said two sets of electrode groups consist of an anode and a control electrode.

4. The display device as defined in claim 2, wherein said two sets of electrode groups consist of control electrodes.

5. The display device as defined in claim 2, wherein said electrode group stretched in said space within said envelope is a control electrode.

6. The display device as defined in claim 2, wherein said auxiliary electrode assembly is arranged above said main electrode assembly through a gap of microdistance.

7. The display device as defined in claim 2, wherein said auxiliary electrode assembly and said main electrode assembly are arranged in contact with each other.

8. The display device as defined in claim 2, wherein said auxiliary electrode assembly and said main electrode assembly are arranged horizontally on the same plane through a gap of microdistance.

* * * * *